US008657698B2

(12) United States Patent
Basile

(10) Patent No.: US 8,657,698 B2
(45) Date of Patent: Feb. 25, 2014

(54) GOLF CLUB SWINGING APPARATUS

(76) Inventor: Joshua Basile, Potomac, MD (US)

( * ) Notice: Subject to any disclaimer, the term of this patent is extended or adjusted under 35 U.S.C. 154(b) by 0 days.

(21) Appl. No.: 13/561,948

(22) Filed: Jul. 30, 2012

(65) Prior Publication Data

US 2014/0031137 A1 Jan. 30, 2014

(51) Int. Cl.
*A63B 69/36* (2006.01)

(52) U.S. Cl.
USPC ..... 473/229; 473/258

(58) Field of Classification Search
USPC ..... 473/219, 226, 229, 257, 258, 259, 260, 473/261, 266
See application file for complete search history.

(56) References Cited

U.S. PATENT DOCUMENTS 3,132,865 A * 5/1964 Parker ..... 473/229
3,444,729 A * 5/1969 Shobert ..... 73/816
5,074,565 A * 12/1991 Tucker ..... 473/229
5,984,798 A * 11/1999 Gilmour ..... 473/221
7,806,780 B1 * 10/2010 Plunkett ..... 473/257
8,267,812 B1 * 9/2012 Sery ..... 473/409

* cited by examiner

*Primary Examiner* — Nini Legesse
(74) *Attorney, Agent, or Firm* — Kirby B. Drake; Klemchuk Kubasta LLP

(57) ABSTRACT

A golf club swinging apparatus configured to support and provide for motion of a golf club along a pendulum swing path may comprise a frame, a rotation mechanism having club and frame coupling components, and an angle measurement mechanism. Another embodiment may comprise a frame, and a rotation mechanism configured to couple a golf club to the frame and to provide for rotation about a rotation point such that the golf club may follow a pendulum swing path through a strike position. Yet another embodiment may comprise a frame having a base component, a vertical component, and a cross-member component, a rotation mechanism rotatably coupled with the cross-member component, and a protractor having a freely rotatable arm configured to couple with the golf club and measure an angle at which the golf club is rotated about the rotation point along a swing path.

3 Claims, 8 Drawing Sheets

GOLF CLUB SWINGING APPARATUS

FIELD OF THE DISCLOSURE

The present disclosure generally relates to a golf club swinging apparatus, and more particularly, to a golf club swinging apparatus configured to support and provide for motion of a golf club along a pendulum swing path.

BACKGROUND

Many disabled and elderly persons are inhibited or precluded from playing golf due to various aspects of their conditions. Some may have trouble getting into position to swing a golf club, such as those who rely on a wheelchair for mobility. Others may not be able to effectively grip and/or move their body to swing the club, such as persons suffering from certain paralysis. Still others may be physically able, but lack the cognitive ability to swing a golf club in a traditional manner, such as some mentally disabled or autistic persons.

Additionally, many persons seek to improve their golf swing through the use of training apparatuses. Training apparatuses physically manipulate a person's movement or the movement of their club to teach certain swing mechanics. Many persons learn more effectively by witnessing visual demonstrations of certain techniques including, but not limited to, the pendulum-like swing motion often used in chipping and putting.

SUMMARY

Embodiments of the present disclosure generally provide a golf club swinging apparatus that may assist disabled persons in swinging or actively directing the swing of a golf club. The apparatus may also demonstrate the pendulum-like swinging motion often desired for golf swings.

The present disclosure is directed to a golf club swinging apparatus configured to support and provide for motion of a golf club along a pendulum swing path, the golf club swinging apparatus may comprise a frame having one or more substantially vertical components; a rotation mechanism having a club coupling component and a frame coupling component; and an angle measurement mechanism configured to measure an angle at which a golf club is rotated about the rotation point along the swing path.

In an embodiment, the frame further may comprise a base component. In another embodiment, the frame further may comprise a cross-member component. In yet another embodiment, the frame may comprise one or more outriggers.

In an embodiment, the frame coupling component may comprise a rotatable coupler configured to rotatably couple with the frame. In another embodiment, the frame coupling component may comprise a rotatable cross-member rotatably coupled with the frame.

In various embodiments, the golf club swinging apparatus may further comprise an angle measurement mechanism. In an embodiment, the angle measurement mechanism may be coupled with the golf club. In another embodiment, the angle measurement mechanism may be coupled to the frame. In yet another embodiment, the angle measurement mechanism may comprise a protractor and a freely rotatable arm. In still another embodiment, the angle measurement mechanism may comprise a protractor.

In various embodiments, the golf club swinging apparatus further may comprise a power augmentation mechanism. In an embodiment, the power augmentation mechanism may comprise one or more torsion springs. In yet another embodiment, the power augmentation mechanism may comprise one or more weights configured to couple with one or more portions of the golf club.

In another aspect, the present disclosure is directed to a golf club swinging apparatus configured to support and provide for motion of a golf club along a pendulum swing path, the golf club swinging apparatus may comprise a frame configured to support a golf club in a substantially vertical position at a strike position, the strike position coinciding with the pendulum swing path; and a rotation mechanism configured to couple a golf club to the frame and to provide for rotation of the golf club about a rotation point such that the golf club follows the pendulum swing path through the strike position.

In an embodiment, the frame may be configured to not obstruct a travel path of a golf ball when struck by the golf club. In another embodiment, the rotation mechanism may be configured to releasably retain the golf club. In yet another embodiment, the rotation mechanism may be configured to couple the golf club to the frame at a position laterally offset from the strike position. In various embodiments, the golf club swinging apparatus further may comprise an angle measurement mechanism configured to measure an angle at which the golf club is rotated about the rotation point along the swing path.

In another aspect, the present disclosure is directed to a golf club swinging apparatus configured to support and provide for motion of a golf club along a pendulum swing path, the golf swing apparatus may comprise a frame having a base component, a vertical component, and a cross-member component configured to support a golf club in a substantially vertical position at a strike position, the strike position coinciding with the pendulum swing path; a rotation mechanism rotatably coupled with the cross-member, wherein the rotation mechanism may be configured to couple the golf club to the frame and to provide for rotation of the golf club about a rotation point such that the golf club may follow the pendulum swing path through the strike position; and a protractor having a freely rotatable arm being configured couple with the golf club and to measure an angle at which the golf club is rotated about the rotation point along the swing path.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure generally provide a golf club swinging apparatus. In various embodiments, the golf club swinging apparatus may be used to assist disabled persons in swinging a golf club. In various embodiments, the golf club swinging apparatus may be used for instructing or training proper golf swing techniques. In various embodiments, the golf club swinging apparatus may comprise a frame, a club rotation mechanism, and/or an angle measurement mechanism.

FIGS. 1-8 illustrate representative embodiments of golf club swinging apparatus 100 and parts thereof. It should be understood that the components of golf club swinging apparatus 100 and parts thereof shown in FIGS. 1-8 are for illustrative purposes only, and that any other suitable components or subcomponents may be used in conjunction with or in lieu of the components comprising golf club swinging apparatus 100 and the parts of golf club swinging apparatus 100 described herein.

Figure 1:
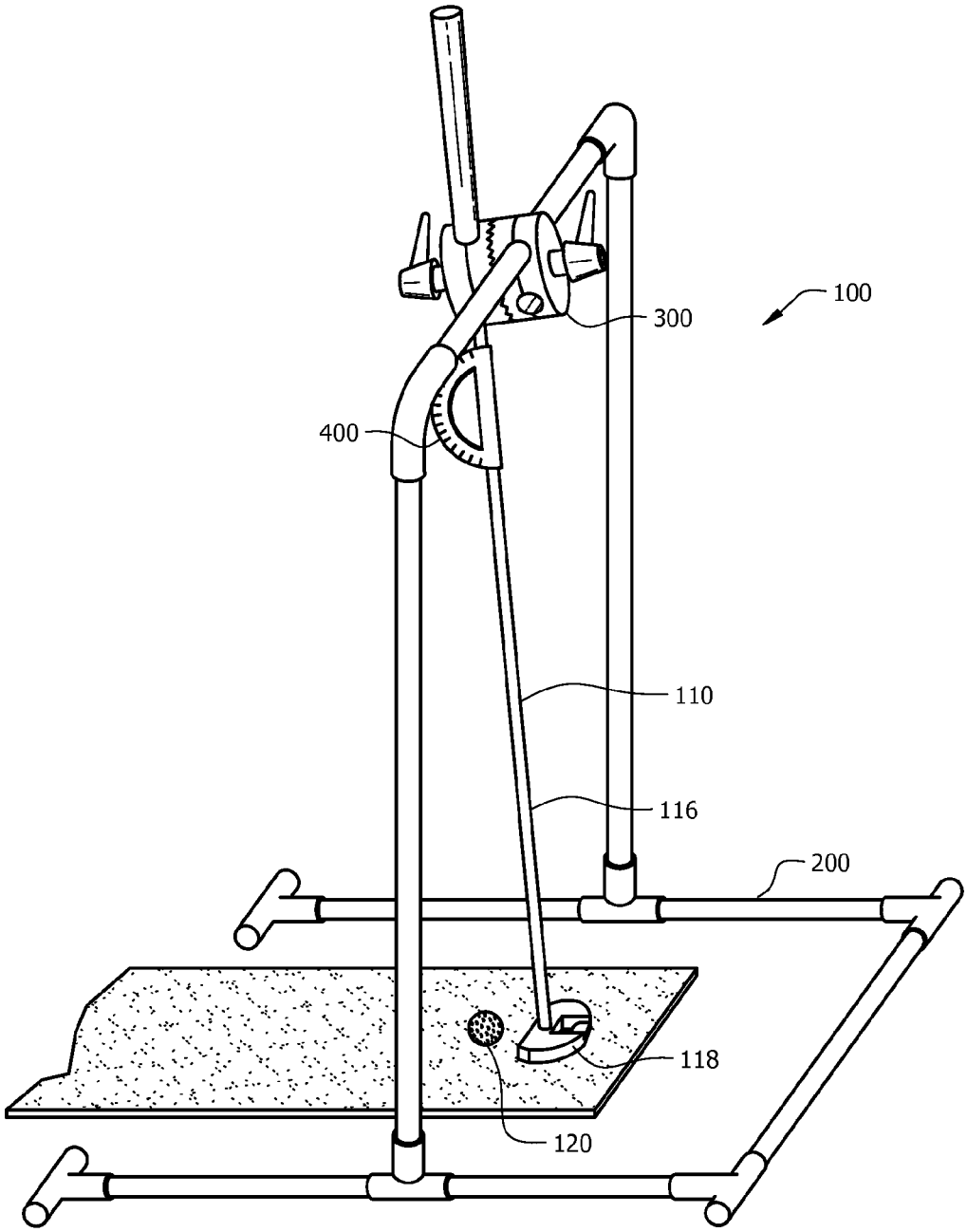
FIG. 1 depicts a perspective view of a golf club swinging apparatus according to an embodiment of the present disclosure.

Referring now to FIG. 1, golf club swinging apparatus 100 may generally comprise frame 200, club rotation mechanism 300, and/or angle measurement mechanism 400. In various embodiments, golf club 110 may be detachably coupled to golf club swinging apparatus 100 or may be integrated into golf club swinging apparatus 100. Golf club 110 may comprise any type of golf club having elongated shaft 116 and head 118 suitable for striking golf ball 120. In various embodiments, golf club swinging apparatus 100 may be configured to support and provide for motion of multiple golf clubs 110 simultaneously.

Figure 2:
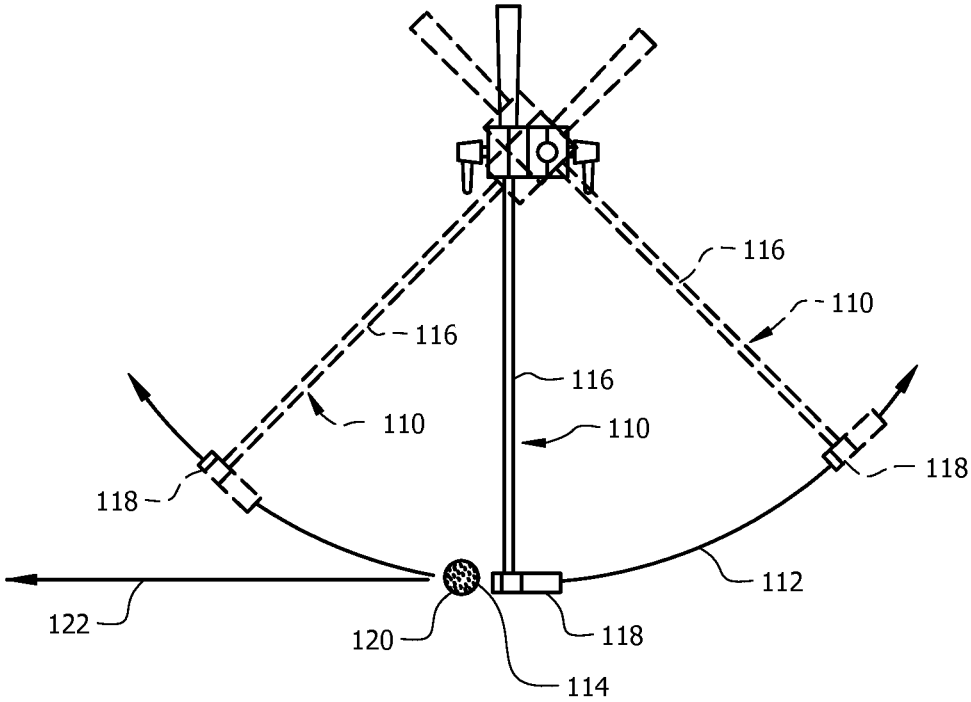
FIG. 2 depicts a schematic view of a golf club swing path and golf ball travel path according to an embodiment of the present disclosure.

Referring now to FIG. 2, elements of golf club swinging apparatus 100 may combine to support and provide for a pendulum-like swing motion to golf club 110 along pendulum-like swing path 112. Golf club swinging apparatus 100 may be positioned such that golf club 110 may be made to strike golf ball 120 at strike position 114 located at or substantially proximate to the bottom of swing path 112. When struck, golf ball 120 may follow travel path 122. Travel path 122 may be dependent on multiple factors including, but not limited to, the type of club face used (putter, wedge, iron, hybrid, driver, etc.), the angle of the club face at strike position 114, and which portion of the club face contacts golf ball 120. In an embodiment, travel path 122 may be substantially aligned with the general direction of swing path 112. While embodiments of the present disclosure may be shown or described in the context of putting golf ball 120 on the ground, the present disclosure should not be limited to putter-type golf clubs 110 or putt-like travel paths 112. Indeed, embodiments of golf club swinging apparatus 100 may be used with other types of clubs 110 and may impart other types of travel paths 112 to golf ball 120 including but not limited to, vertically arced paths such as a chip-like or drive-like shot.

Figure 3:
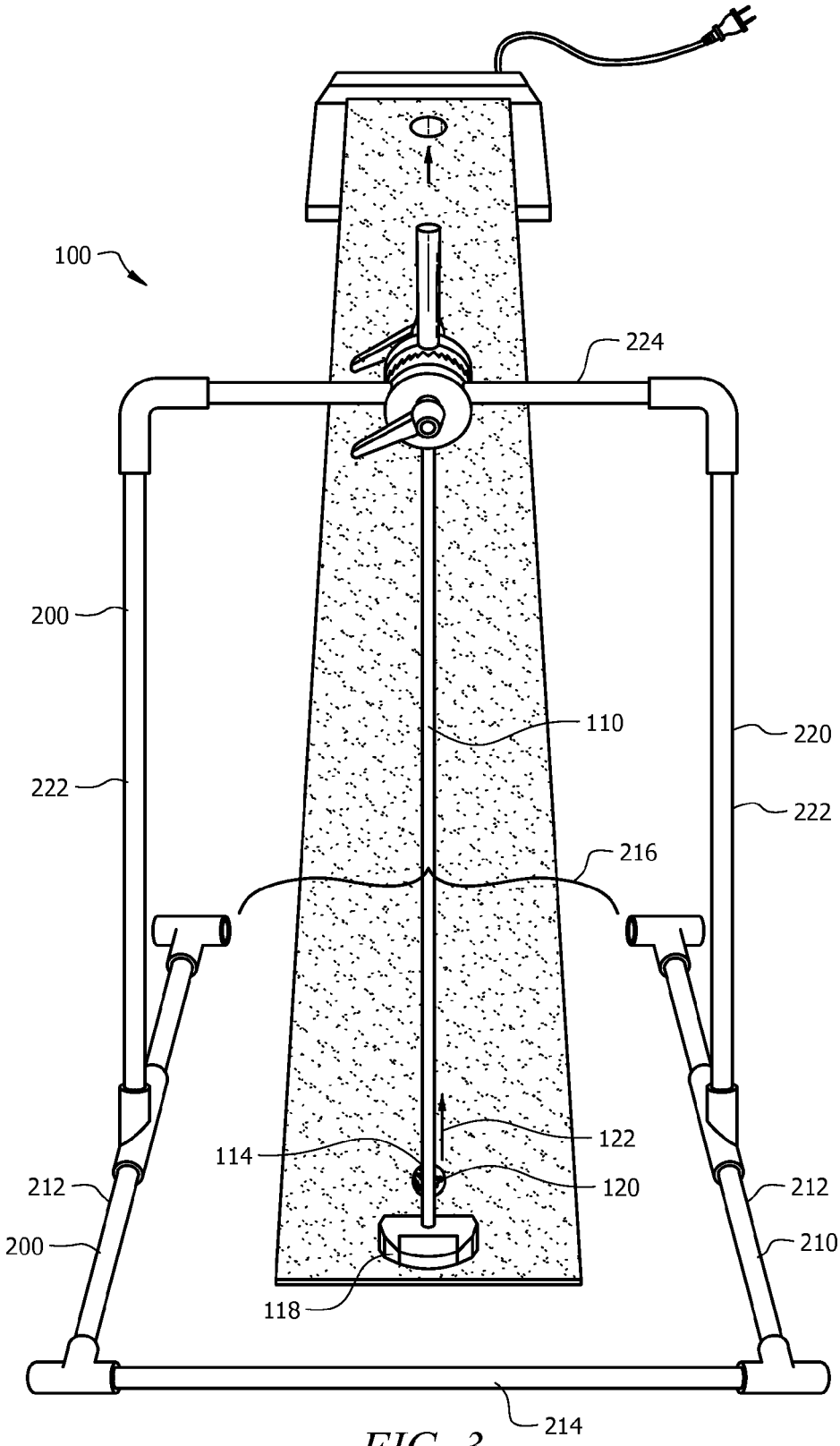
FIG. 3 depicts an elevated rear view of a frame of a golf club swinging apparatus according to an embodiment of the present disclosure.

Referring now to FIG. 3, frame 200 may comprise any structure suitable for supporting golf club 110 in a substantially vertical position above a support surface at strike position 114. Frame 200 may be further configured to avoid obstructing swing path 112 of club 110 or travel path 122 of golf ball 120 during operation. In various embodiments, frame 200 may comprise base component 210 and vertical component 220. Base component 210 may comprise any arrangement of one or more substantially horizontal members 212 suitable for supporting and stabilizing frame 200. In an embodiment, base component 210 may comprise two or more frame elements 212 being substantially oriented in the direction of swing path 112. In another embodiment, one or more base cross-members 214 may span between frame elements 212 to provide additional rigidity and stability. Base cross-members 214 may be situated such that they do not obstruct swing path 112 of golf club 110. For example, base cross-member 214 may be situated in a low and rearward position so as to be outside of swing path 112. Similarly, base component 210 may be configured to have opening 216 near the front so as not to obstruct travel path 122 of golf ball 120. Base component 210 may feature outriggers for improved stability in some embodiments. Vertical component 220 may comprise any arrangement of one or more substantially vertical frame elements 222 suitable to directly or indirectly support golf club 110 in a substantially vertical position. In various embodiments, vertical component 220 may be coupled with or integrated with base component 210. In an embodiment, vertical component 220 may comprise two or more substantially vertical frame elements 222 being located on opposite sides of swing path 112. In various embodiments, frame 200 may further comprise one or more cross-member components 224. In an embodiment, cross-member component 224 may span substantially horizontally between vertical frame elements 222. In various embodiments, frame 200 may be disassembled or otherwise collapsed, folded, etc. for portability. It should be appreciated that the particular shape and construction of frame 200 may vary greatly while achieving the same or similar purpose, and as such, the present disclosure should not be limited to only the embodiments described herein.

Elements of frame 200 may be comprised of any material suitable to support one or more golf clubs 110 in operation. In an embodiment, frame 200 may be comprised of PVC-type piping material and assembled with PVC couplers. In another embodiment, frame 200 may be comprised of a metallic material, such as copper tubing, and may assembled with appropriately sized/shaped pipe couplers and secure welds. It should be appreciated that frame 200 may comprise any number of suitable materials including, but not limited to, plastics, metals, and wood, and any elements of frame 200 may be coupled by any number of suitable mechanisms including, but not limited to, adhesives, solder, screws, and pins. Constructions with wide footprints and heavy, rigid materials may provide for less wobble in operation, thereby improving the power and accuracy of the golf club swinging apparatus 100. In an embodiment, frame 200 may comprise base component 210 and vertical component 220 constructed of copper tubing elements joined by pipe couplers and secured welds, and has overall length, width, and height dimensions of approximately 34", 24", and 33", respectively. It should be appreciated that there may be a number of suitable materials and constructions for a given application.

Figure 4A:
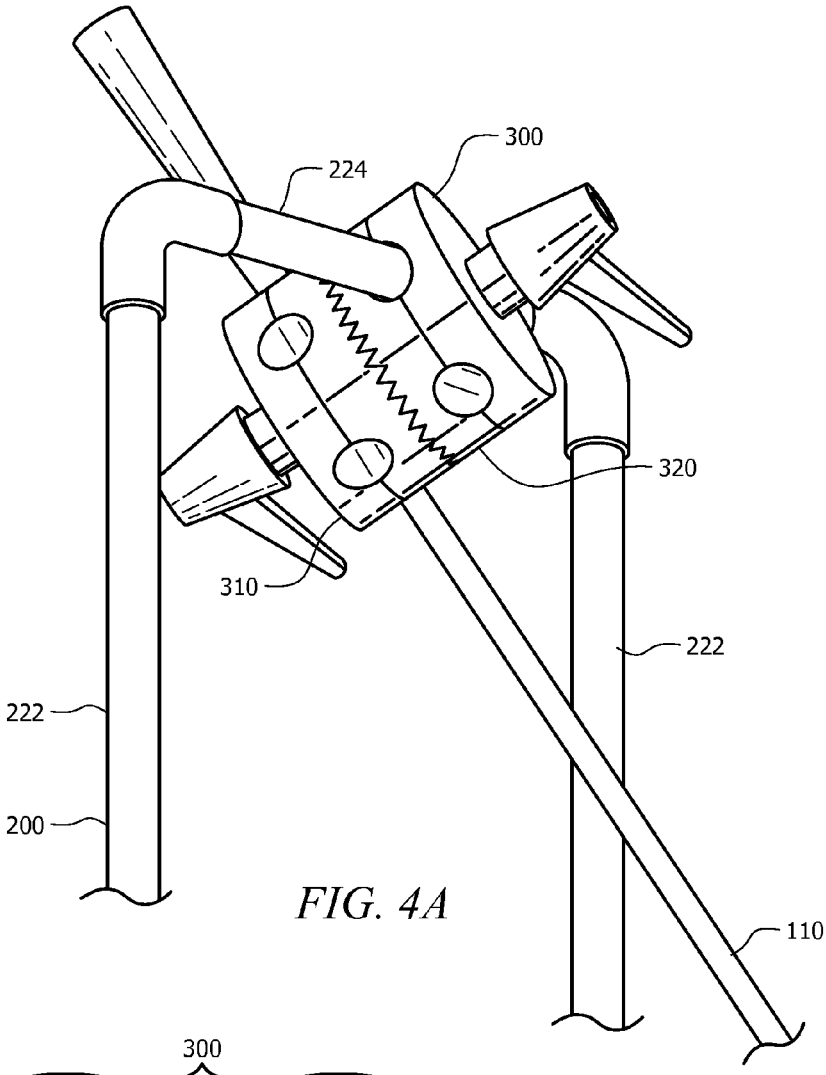
FIG. 4A depicts a perspective side view of a club rotation mechanism of a golf club swinging apparatus according to an embodiment of the present disclosure.
Figure 4B:
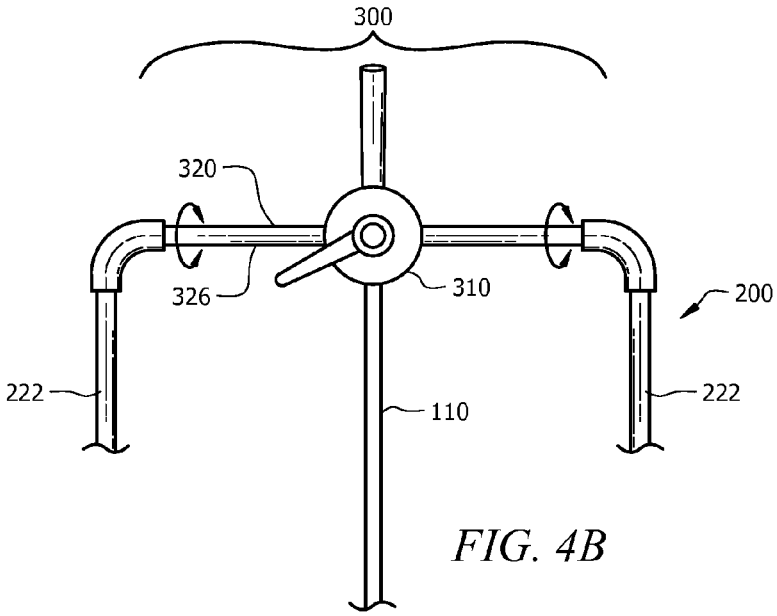
FIG. 4B depicts a rear view of another club rotation mechanism of a golf club swinging apparatus according to an embodiment of the present disclosure.

Referring to FIGS. 4A and 4B, golf club swinging apparatus 100 may further comprise one or more club rotation mechanisms 300. Rotation mechanism 300 may comprise any suitable mechanism for coupling golf club 110 to frame 200 in a manner suitable to provide for rotational motion of golf club 110 along swing path 112. In various embodiments, rotation mechanism 300 may comprise one or more golf club coupling components 310 and one or more frame coupling components 320. Golf club coupling component 310 may comprise any mechanism suitable to retain golf club 110 on rotation mechanism 300. In various embodiments, golf club coupling component 310 may be configured to releasably retain golf club 110 on rotation mechanism 300. In an embodiment, club coupling component 310 may comprise one or more clamps, brackets, clasps, or other suitable mechanism known in the art. In an embodiment, rotation mechanism 300 may comprise a boom arm clamp, such as the Manfrotto™ 124 Clamp or Adorama® Adapter Dual Grip Clamp, available at various retailers like B&H Photo-Video-Pro Audio and Adorama®, respectively. In various embodiments, golf club swinging apparatus 100 may comprise golf club 110—such as where separate golf club 110 may be fixedly coupled to rotation mechanism 300, or through an integrated construction in which rotation mechanism 300 and golf club 110 are integrated (for instance, one-piece). Club coupling component 310 may be further understood in such embodiments to comprise any suitable mechanism for coupling club 110 to rotation mechanism 300 including, but not limited to, welds, adhesives, magnets, or an integrated construction.

Figure 4C:
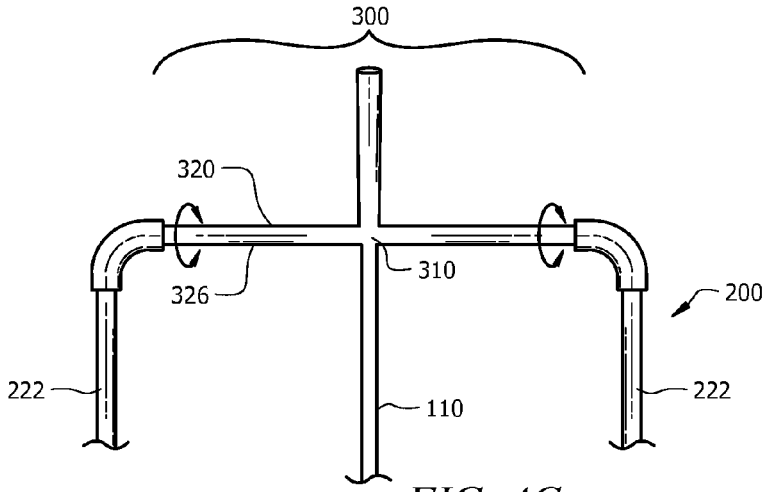
FIG. 4C depicts a rear view of yet another club rotation mechanism of a golf club swinging apparatus according to an embodiment of the present disclosure.

Frame coupling component 320 may comprise any mechanism suitable to rotatably couple rotation mechanism 300 with frame 200. Referring to FIG. 4A, in one embodiment frame coupling component 320 may comprise rotatable coupler 322 configured to rotatably couple with a fixed portion of frame 200. In one such embodiment, rotatable coupler 322 may rotatably couple with fixed cross-member 224. Referring to FIG. 4B, in another embodiment frame coupling component 320 may comprise a rotatable cross-member 326, wherein club coupling component 310 may be fixedly coupled to or integrated with rotatable cross-member 326, and rotatable cross-member 326 may be rotatably coupled with frame 200. In an embodiment, rotatable cross-member 326 may span between and rotatably couple with vertical frame elements 222. Referring to FIG. 4C, golf club swinging apparatus 100 may comprise an integrated construction in which golf club 110 is integrated with rotation mechanism 300.

The height at which golf club 110 is rotationally coupled to frame 200 may affect the swing power capability of golf club swinging apparatus 100. Generally speaking, the higher the point at which golf club 110 is coupled with golf club swinging apparatus 100, the longer the swing path 112 and the more powerful the stroke. Golf club swinging apparatus 100 may further comprise a power augmentation mechanism for augmenting the power of a swing (not shown). In various embodiments, a torsion spring (perhaps similar to that used in mousetraps) may be coupled with frame 200, rotation mechanism 300, and/or golf club 110 and configured to increase the speed at which golf club 110 rotates forward along swing path 112. In another embodiment, weights may be added to the lower portion of golf club 110 (for example, to the head or lower shaft). In yet another embodiment, golf club 110 may feature multiple club heads 118 extending laterally at various angles from shaft 116. The additional heads 118 may add weight, thereby increasing swing power, and may provide for the use of a particular club head, such as club head 118, for a given shot by simply positioning swinging apparatus 100 such that strike position 114 of the chosen club head aligns with golf ball 120. One having ordinary skill in the art will recognize that the particular construction used to provide for rotational motion of a golf club 110 along swing path 112 may vary greatly while achieving the same or similar purpose, and as such, the present disclosure should not be limited to only the embodiments described herein.

Figure 5:
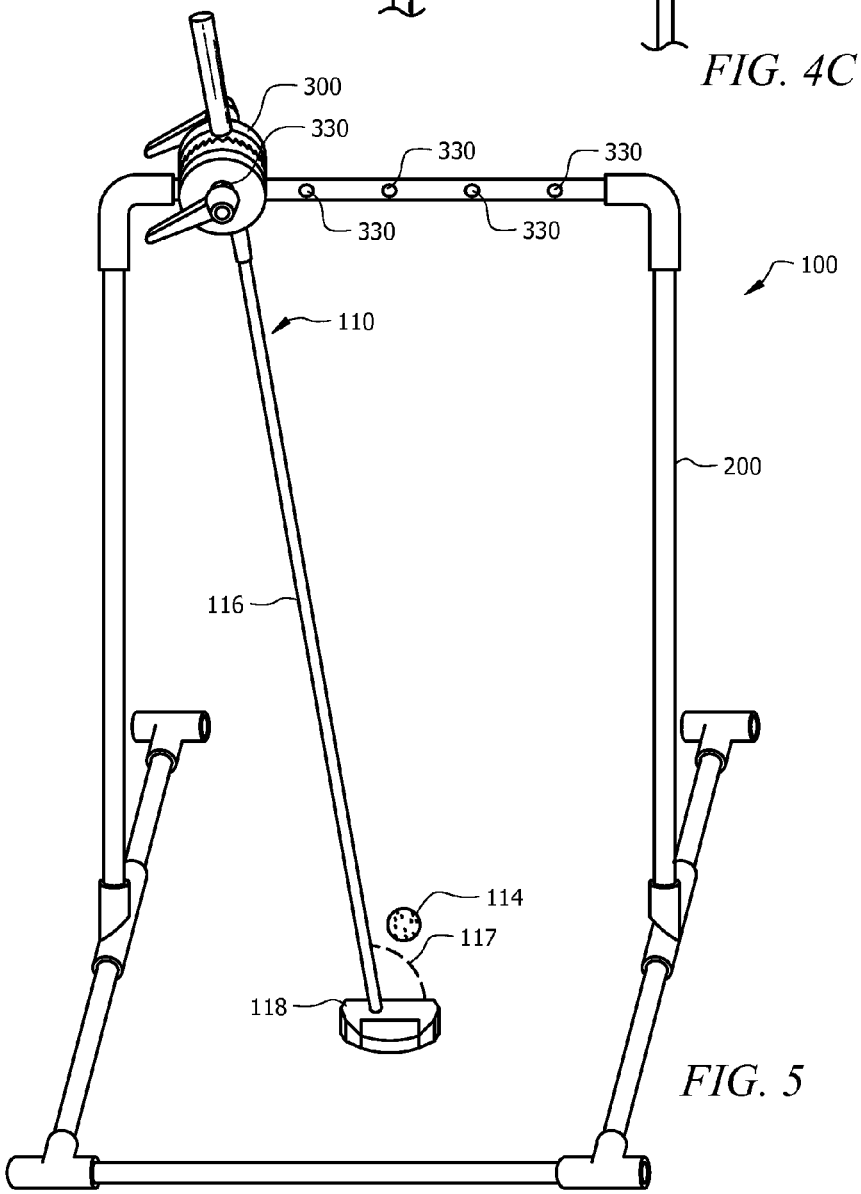
FIG. 5 depicts an perspective rear view of possible lateral coupling positions on a golf club swinging apparatus according to an embodiment of the present disclosure.

Referring now to FIG. 5, in various embodiments golf club swinging apparatus 100 may be configured such that golf club 110 may be adjustably coupled to frame 200. In an embodiment, golf club 110 may be coupled to frame 200 in multiple lateral coupling positions 330. Many golf clubs have shaft 116 that connects at angle 117 from the vertical to head 118. As such, it may be beneficial to couple golf club 110 to frame 200 at a lateral coupling position not directly above strike position 114 to ensure a proper lie angle if an angled club is used. Alternatively, club 110 having a non-angled shaft-to-head configuration may be coupled to frame 200 directly over strike position 114—this may create a more balanced, traditional-pendulum type swing. Similarly, golf club swinging apparatus 100 may be configured such that golf club 110 may be coupled to frame 200 at various points along its shaft or handle, thereby accommodating various club lengths. An appropriate lateral coupling position 330 may be determined as a function of the height at which club 110 couples with frame 200 using basic geometry.

Figure 6A:
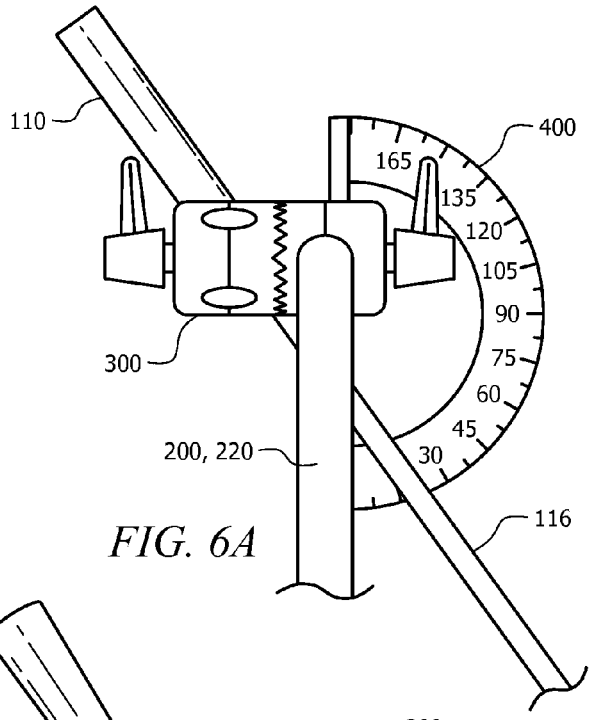
FIG. 6A depicts a side view of an angle measurement mechanism coupled with the frame of a golf club swinging apparatus according to an embodiment of the present disclosure.
Figure 6B:
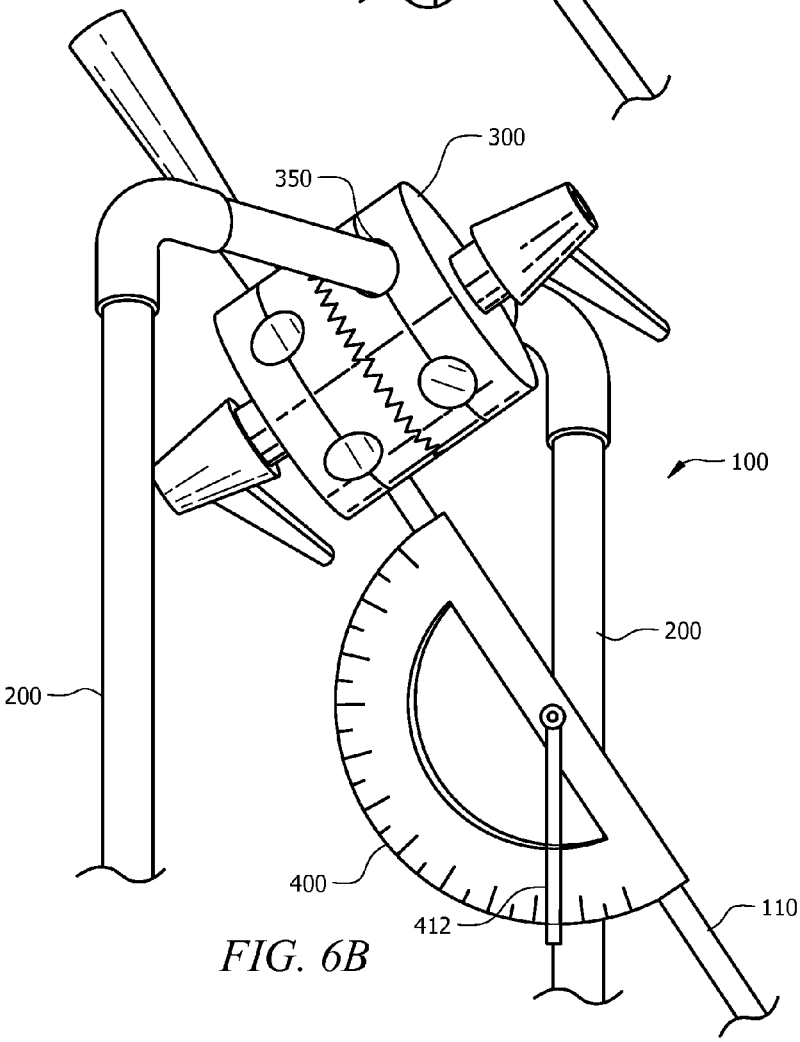
FIG. 6B depicts a perspective view of another angle measurement mechanism coupled with a golf club on a golf club swinging apparatus according to an embodiment of the present disclosure.

Referring now to FIGS. 6A and 6B, golf club swinging apparatus 100 may further comprise angle measurement mechanism 400. In various embodiments, the angle at which club 110 is rotated during a backswing may correlate with the power of the swing, and thereby correlate with the distance golf ball 120 may travel when struck. Angle measurement mechanism 400 may comprise any mechanism suitable to indicate or measure the angle at which club 110 may be rotated about rotation point 350. In various embodiments, angle measurement mechanism may comprise a protractor. The protractor may be positioned such that the rotation angle of club 110 may be measured during a backswing. Referring to FIG. 6A, in an embodiment, a protractor may be mounted on a vertical member 220 of frame 200 such that it may be in longitudinal alignment with strike position 114. Referring to FIG. 6B, in another embodiment, a protractor having freely-rotatable arm 412 (or similar mechanism providing the same functionality, such as a string) may be mounted on golf club 110 such that gravity orients arm 412 vertically, thereby indicating the angle of the club backswing on the protractor. In an embodiment, angle measurement mechanism 400 may be detachably coupled from golf club 110 using any suitable coupler, such as Velcro, adhesives, or magnets, such that it may be used on multiple clubs 110. One having ordinary skill in the art will recognize that club rotation angle may be indicated using a multitude of mechanisms known in the art may, and as such, the present disclosure should not be limited to only the embodiments described herein.

Figure 7:
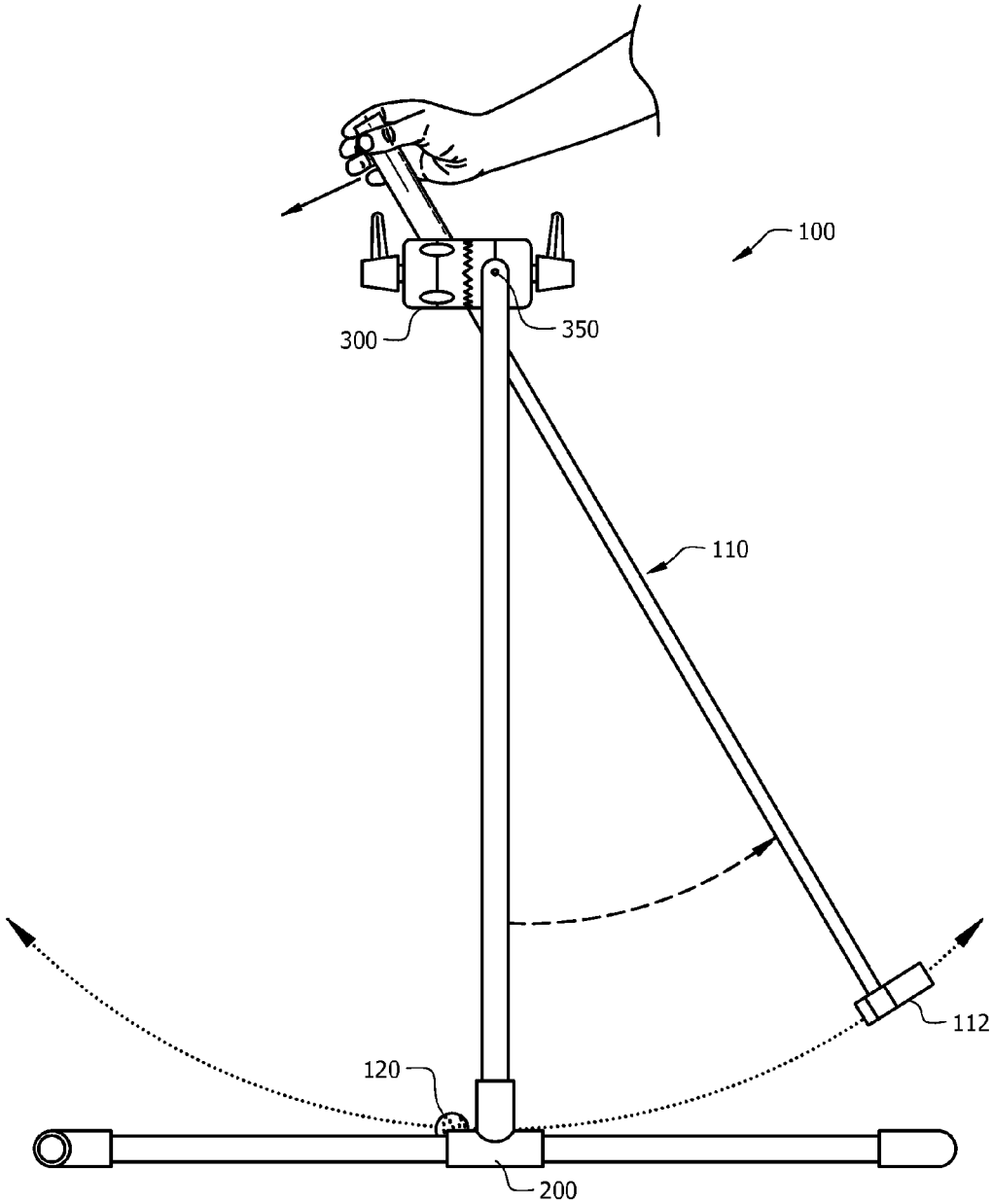
FIG. 7 depicts a side schematic view of a user operating a golf club swinging apparatus according to an embodiment of the present disclosure.

In operation, golf club swinging apparatus 100 may be positioned on a support surface (such as miniature golf artificial turf surface, a putting green, or a fairway) and oriented in a desired direction. If golf ball 120 must be played from a specific location, golf club swinging apparatus 100 may be further positioned such that strike position 114 may substantially coincide with the current location of golf ball 120. Alternatively, golf club swinging apparatus 100 may be placed in any desired location, and golf ball 120 may be placed at strike position 114 corresponding with the location and configuration of apparatus 100. Referring to FIG. 7, once golf club swinging apparatus 100 is positioned and oriented, golf club 110 may be caused to rotate along swing path 112 in a backswing. Backswing motion may be effected in any suitable manner including, but not limited to, applying a forward and/or downward force to golf club 110 above rotation point 350, thereby causing the club to swing backwards along swing path 112. Similarly, backswing motion may be effected by pulling club 110 backward and/or upward below the coupling point 350 along swing path 112. Generally speaking, the power of a given stroke correlates with the extent of backswing motion—that is, the longer the backswing, the more powerful the stroke in most cases. Angle measurement mechanism 400 may be used to more precisely determine the power of a given stroke if so equipped. For embodiments comprising a protractor coupled to golf club 110, one may view the protractor from the side to determine the angle at which golf club 110 has been rotated from the vertical. Gravity may cause freely-rotating arm 412 to point downward while the protractor rotates with golf club 110, thereby causing freely-rotating arm 412 to point to an angle measurement on the protractor as shown in FIG. 6B. For embodiments comprising a protractor coupled with frame 200, one may view golf club 110 against the backdrop of the fixed protractor to determine the angle of golf club 110. Stated otherwise, the shaft or other suitable element of golf club 110 may point to an angle measurement on the protractor as shown in FIG. 6A. One having ordinary skill in the art will recognize how to operate alternative embodiments of angle measurement mechanism 400 within the scope of the present disclosure. In an embodiment, a table relating shot distance to backswing angle may be used to more precisely gauge a proper backswing angle for a given configuration on a given shot. Next, golf club 110 may be released, thereby causing it to swing forward along swing path 112. Golf club 110 may continue along swing path 112 and may strike a golf ball 120 located at strike position 114, causing the golf ball 120 to move along a given travel path 122.

Figure 8:
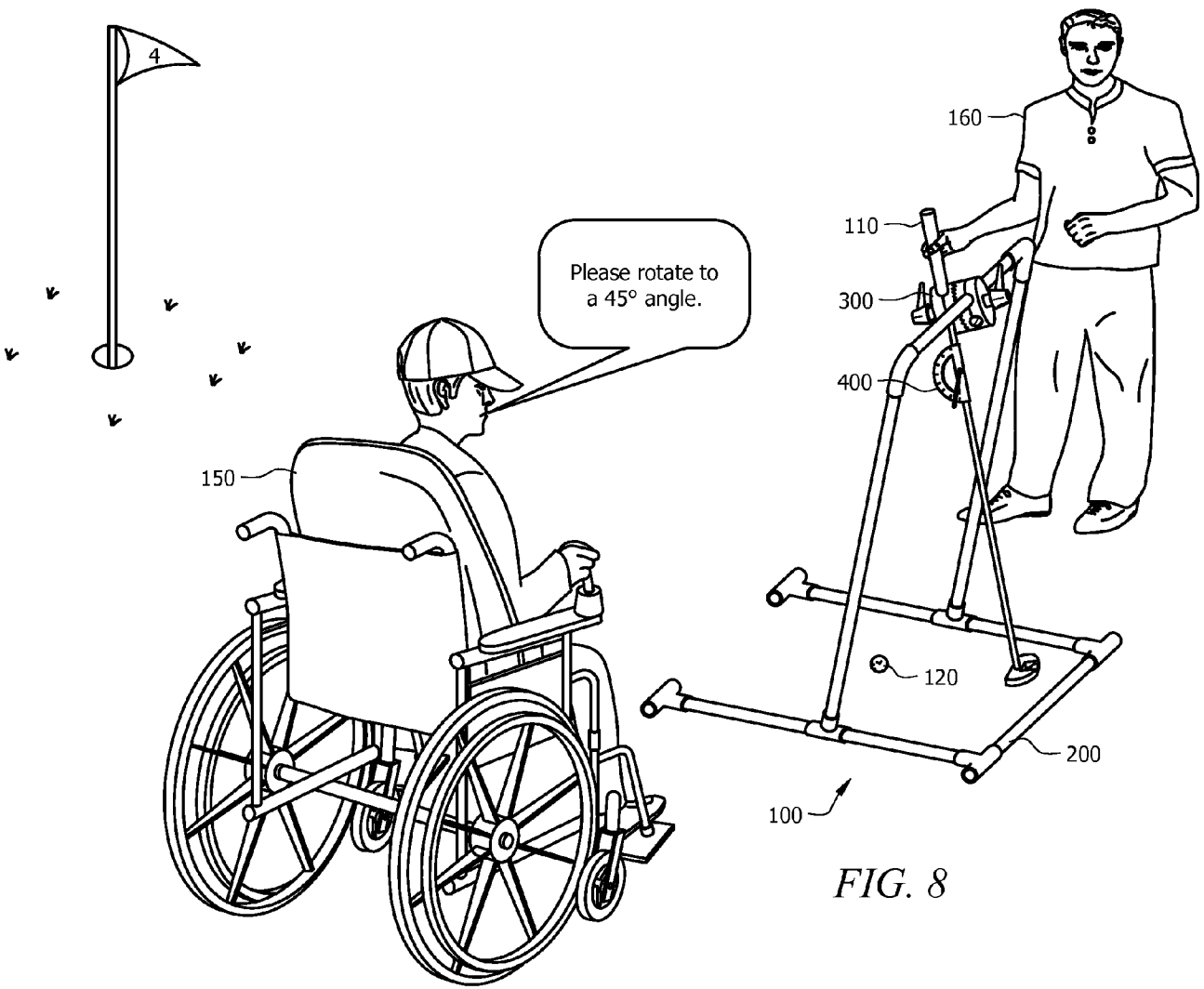
FIG. 8 depicts a perspective view of another possible operation of a golf club swinging apparatus according to an embodiment of the present disclosure.

In various embodiments, golf club swinging apparatus 100 may be used to assist a disabled person ("player 150") in playing golf. Referring to FIG. 8, in an embodiment player 150 may request that assistant 160 place golf club swinging apparatus 100 in a desired position and orientation, and request that assistant 160 rotate golf club 110 to a desired extent. In another embodiment, player 150 may operate golf club swinging apparatus 100 themselves. Player 150 could position himself in a location where he could rotate golf club 110 while viewing the angle, of rotation, perhaps from the side. In various embodiments, golf club swinging apparatus 100 could be used for instructing or training proper golf swing techniques. A student could view multiple aspects of the club motion including, but not limited to, its pendulum-like motion and how club 110 contacts ball 120. It should be recognized that golf club swinging apparatus 100 may be used for a number of purposes, and the present disclosure should not be limited only to the examples described herein.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A golf club swinging apparatus configured to support and provide for motion of a golf club along a pendulum swing path, the golf dub swinging apparatus comprising:

a frame having one car more substantially vertical components;

a rotation mechanism having a club coupling component and a frame coupling component; and an angle measurement mechanism configured to measure an angle at which a golf club is rotated about the rotation point along the swing path, the angle measurement mechanism comprising a protractor and a freely rotatable arm.

2. A golf club swinging apparatus configured to support and provide for motion of a golf club along a pendulum swing path, the golf club swinging apparatus comprising:

a frame having one or more substantially vertical components;

a rotation mechanism having a club coupling component and a frame coupling component; and an angle measurement mechanism configured to measure an angle at which a golf club is rotated about the rotation point along the swing path, the angle measurement mechanism comprising a protractor.

3. A golf club swinging apparatus configured to support and provide for motion of a golf club along a pendulum swing path, the golf swing apparatus comprising:

a frame having a base component, a vertical component, and a cross-member component configured to support the golf club in a substantially vertical position at a strike position, the strike position coinciding with the pendulum swing path;

a rotation mechanism rotatably coupled with the cross-member component, wherein the rotation mechanism is configured to couple the golf club to the frame and to provide for rotation of the golf club about a rotation point such that the golf club follows the pendulum swing path through the strike position; and a protractor having a freely rotatable arm configured to couple with the golf club and measure an angle at which the golf club is rotated about the rotation point along the pendulum swing path.

* * * * *